United States Patent [19]

Sillars

[11] Patent Number: 4,541,333

[45] Date of Patent: Sep. 17, 1985

[54] ROTARY APPARATUS FOR PRINTING QUASI RANDOM NUMBER TABLES

[76] Inventor: Ian M. Sillars, 65A Pine Street, Cammeray, New South Wales 2062, Australia

[21] Appl. No.: 679,863

[22] Filed: Dec. 10, 1984

[30] Foreign Application Priority Data

Sep. 17, 1984 [AU] Australia ..... PG7178

[51] Int. Cl.[4] ..... B41J 45/00

[52] U.S. Cl. ..... 101/76; 101/142

[58] Field of Search ..... 101/70, 72, 74, 76, 101/141-142, 177, 219, 426; 270/1.1, 18

[56] References Cited

U.S. PATENT DOCUMENTS

| | | | |
|---|---|---|---|
| 3,421,752 | 1/1969 | Folino | 101/72 |
| 3,768,801 | 10/1973 | Maynard et al. | 270/53 |
| 3,822,876 | 7/1974 | Frain | 101/426 |
| 3,998,446 | 12/1976 | Dent | 101/72 |
| 4,287,824 | 9/1981 | Boyle | 101/76 |
| 4,421,027 | 12/1983 | Fischer | 101/142 |
| 4,441,423 | 4/1984 | Germann | 101/177 |
| 4,444,103 | 4/1984 | Cronin | 101/72 |
| 4,470,348 | 9/1984 | Seeley et al. | 101/219 |
| 4,479,431 | 10/1984 | Germann | 101/141 X |

FOREIGN PATENT DOCUMENTS

| | | | |
|---|---|---|---|
| 1047210 | 7/1979 | Canada | 101/72 |
| 2706565 | 8/1977 | Fed. Rep. of Germany | 101/177 |
| 2107250 | 4/1983 | United Kingdom | 101/76 |
| 2109305 | 6/1983 | United Kingdom | 101/70 |

*Primary Examiner*—E. H. Eickholt

*Attorney, Agent, or Firm*—Dressler, Goldsmith, Shore, Sutker & Milnamow, Ltd.

[57] ABSTRACT

Apparatus for printing quasi number random tables used in games of chance onto newspaper preprints for convenient insertion into and distribution with newspapers. The apparatus comprises a flexographic printing press, such as a Victory Kidder press, provided with a number of cylinders of different circumferences arranged about a central drum. Each circumference is a multiple of a basic pitch value and each cylinder is arranged to print numbers or other symbols to be interspaced between numbers or symbols printed by other cylinders in a quasi random array.

9 Claims, 2 Drawing Figures

ROTARY APPARATUS FOR PRINTING QUASI RANDOM NUMBER TABLES

BACKGROUND OF THE INVENTION

This invention relates to apparatus for printing quasi random number tables and has been devised particularly though not solely for the printing of such tables on newspaper preprints for incorporation with newspapers. Newspaper preprints are normally page sized inserts printed on newsprint or similar paper which are inserted into a newspaper for advertising purposes or as a colour supplement etc. Such preprints are commonly 600 mm×390 mm in size.

It is well known to provide tables of apparently random numbers for use in playing games of chance such as bingo or various other games requiring the selection of a number of "winning numbers" from a table of such numbers. Further adaptations of these games require a winning combination incorporating, for example, three numbers or symbols the same in a row or various other combinations. Throughout this specification the term "number" is used to identify the character appearing in the table, but it will be appreciated that other symbols, e.g. similar to those used in poker machines, may be substituted for numbers. All of these games require tables of apparently random numbers from which the selection of "winning numbers" may be made. In fact these tables are seldom true random number tables but incorporate a very large number of variables which are eventually repeated after a large number of tables have been printed. To the end user, however, each table appears to incorporate a matrix of apparently random numbers or symbols and is referred to throughout this specification as a "quasi random number table".

Tables of quasi random numbers are frequently distributed with newspapers so that the newspaper purchaser may participate in a game of chance with the possibility of winning a prize. In the past such tables have been printed on separate cards and distributed with the newspapers by hand at the point of sale. Such procedures are time consuming and costly both in the printing phase and in the distribution phase.

SUMMARY OF THE INVENTION

It is therefore an object of the present invention to provide apparatus for printing quasi random number tables which will obviate or minimise the foregoing disadvantages in a simple yet effective manner, or which will at least provide the public with a useful choice.

Accordingly the invention consists in apparatus for printing quasi random number tables (as herein defined) onto newsprint, comprising a flexographic printing press of the type having at least two cylinders arrayed about a central drum, said cylinders including a pair of table printing cylinders having different circumferences, the circumference of each cylinder being a multiple of a basic pitch value, each one of the pair of table printing cylinders being arranged to print a plurality of rows of numbers, the numbers in each row being spaced from one another and interspaced with numbers printed from the other of the pair of table printing cylinders.

Preferably the flexographic printing press is provided with two such pairs of table printing cylinders, the second pair of cylinders being arranged to print a plurality of rows of numbers interspaced between the rows of numbers printed by the first pair of table printing cylinders.

Preferably one or more background printing cylinders are also provided, arranged to print background frameworks and/or supporting artwork in conjunction with the quasi random number tables.

Preferably two said background printing cylinders are provided, each of the same circumference which is a multiple of said basic pitch value.

Preferably the printing press is arranged to print onto 600 mm×390 mm preprints.

Preferably one said pair of table printing cylinders have circumferences which are 8× and 12× multiples of the basic pitch value respectively.

Preferably the other said pair of table printing cylinders have circumferences which are 6× and 14× multiples of the basic pitch value respectively.

Preferably the cylinders are adapted for use in a Victory Kidder central impression press and have circumferences determined as follows:

| | Basic Pitch Multiple | Cylinder Circumference (mm) |
|---|---|---|
| First pair of table printing cylinders | 8x | 480 |
| | 12x | 720 |
| Second pair of table printing cylinders | 6x | 360 |
| | 14x | 840 |

Preferably the background printing cylinders each have a circumference 10× the basic pitch value (600 mm on the Victory Kidder machine)

DESCRIPTION OF THE DRAWINGS

Notwithstanding any other forms that may fall within its scope, one preferred form of the invention will now be described by way of example only with reference to the accompany drawings, in which.

DESCRIPTION OF THE PREFERRED EMBODIMENT

Figure 1:
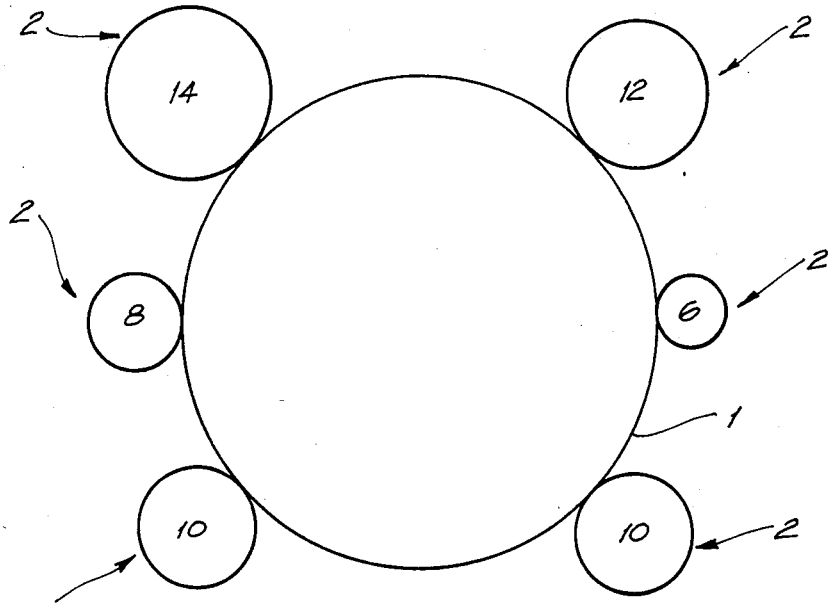
FIG. 1 is a diagrammatic end view of a flexographic printing press incorporating printing cylinders arranged according to the invention.

In the preferred form of the invention a flexographic printing press, for example a Victory Kidder central impression press, is set up to print a series of quasi random number tables as follows.

The press comprises a central drum 1 around which is arrayed a plurality of printing cylinders 2 in the manner well known for use in, for example, a six colour press. Each cylinder has a circumference determined by the role that it plays in printing the quasi random number tables, each circumference being a multiple of a basic pitch value. For convenience the cylinders are hereinafter referred to by reference numbers corresponding to the basic pitch value multiple which determines their circumference.

The cylinders comprise two background printing cylinders 10, each having a circumference of 10× the basic pitch value, which is typically 600 mm when used on a Victory Kidder machine. The background printing cylinders are used to print material such as frameworks 4 or artwork 5 in the attractive presentation of the series of tables. The background printing cylinders may also be used to print explanatory material onto the 600 mm×390 mm preprint used for the printing of the tables.

The cylinders 2 further incorporate a first pair of table printing cylinders 8 and 12. Cylinder 8 has a circumference which is 8× the basic pitch value (480 mm) and cylinder 12 has a circumference which is 12× the basic pitch value (720 mm). The machine is further provided with a second pair of table printing cylinders 6 and 14 having circumferences of 6× the basic pitch value (360 mm) and 14× the basic pitch value (840 mm) respectively.

Figure 2:
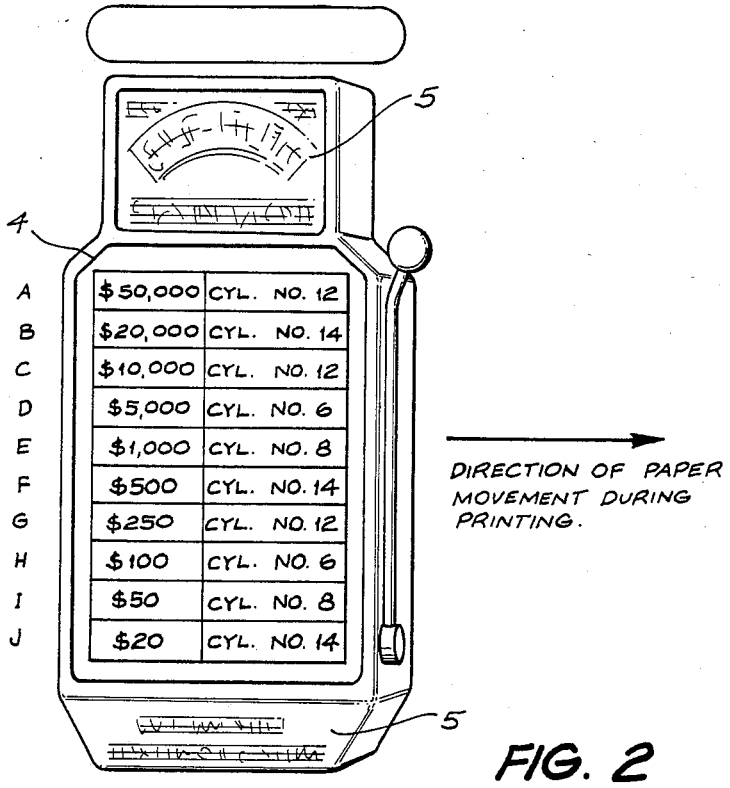
FIG. 2 is an example of a quasi random number table adapted to be printed by the apparatus as shown in FIG. 1.

In use the table printing cylinders are arranged to print quasi random sequences of numbers as follows. The rows of numbers in the table may be conveniently designated rows A to J as shown in FIG. 2. One pair of table printing cylinders are arranged to print alternate rows, e.g. rows A C E G and I and the other pair of table printing cylinders are arranged to print interspersed rows B D F H and J.

One cylinder of each pair prints rows of numbers, each number in the row having a space to the next number, the other cylinder in the pair also printing rows of numbers aligned with the rows printed by the first cylinder, each number printed by the second cylinder being interspaced between the numbers printed by the first cylinder.

Although FIG. 2 shows a print-out with the words "CYL. NO.12" etc. alongside each prize value, this is for reference only, showing the cylinder which would be used to print that particular row. Each row will have printed therein three number values, e.g. 23, 16, 4, obtained from a matrix of random numbers from 1 to 99 set up on the relevant cylinder. The object of this particular game is to get three numbers the same alongside a prize in order to win that prize.

The game can be varied by using a new control matrix to suit the particular requirements of that game.

The number values in row A (for example) do not appear in any other row. This forms part of the theory behind the game so that in each panel, i.e. rows A-J, a numeral cannot be printed more than once, so avoiding confusion on the part of the player.

A plurality of tables such as that shown in FIG. 2 would normally be printed across the length of a preprint (e.g. 10 tables side-by-side across the 600 mm dimension of a 600×390 preprint).

In this manner the numbers appear in a different sequence in consecutive tables which are printed side-by-side, giving the appearance of a random number distribution over a large number of tables.

It is a particular feature of this invention that the apparatus enables a series of random number tables to be printed onto newspaper preprints which may be machine processed and wrapped for incorporation with a normal newspaper at the point of printing. This process therefore saves the cost of the separate printing of random number tables onto cards and does away with the additional handling costs necessary for the distribution of those separate random number tables with each newspaper.

What I claim is:

1. Apparatus for printing quasi random number tables (as herein defined) onto newsprint, comprising a flexographic printing press of the type having at least two cylinders arrayed about a central drum, said cylinders including a pair of table printing cylinders having different circumferences, the circumference of each cylinder being a multiple of a basic pitch value, each one of the pair of table printing cylinders being arranged to print a plurality of rows of numbers, the numbers in each row being spaced from one another and interspaced with numbers printed from the other of the pair of table printing cylinders.

2. Apparatus as claimed in claim 1 wherein the flexographic printing press is provided with two such pairs of table printing cylinders, the second pair of cylinders being arranged to print a plurality of rows of numbers interspaced between the rows of numbers printed by the first pair of table printing cylinders.

3. Apparatus as claimed in claim 1 wherein one or more background printing cylinders are provided, arranged to print background frameworks and/or supporting artwork in conjunction with the quasi random number tables.

4. Apparatus as claimed in claim 3 wherein two said background printing cylinders are provided, each of the same circumference which is a multiple of said basic pitch value.

5. Apparatus as claimed in claim 1 wherein the printing press is arranged to print onto newspaper preprints.

6. Apparatus as claimed in claim 2 wherein one said pair of table printing cylinders have circumferences which are 8× and 12× multiples of the basic pitch value respectively, and wherein the other said pair of table printing cylinders have circumferences which are 6× and 14× multiples of the basic pitch value respectively.

7. Apparatus as claimed in claim 3 wherein the or each background printing cylinder has a circumference 10× the basic pitch value.

8. Apparatus as claimed in claim 1 wherein said flexographic printing press comprises a Victory Kidder central impression press provided with two said pairs of table printing cylinders, and wherein the basic pitch value is 60 mm, the first said pair of cylinders having circumferences of 480 mm and 720 mm respectively and the second said pair of cylinders having circumferences of 360 mm and 840 mm respectively.

9. Apparatus as claimed in claim 8 wherein one or more background printing cylinders are also provided having a circumference of 600 mm.

* * * * *